US006331676B1

(12) United States Patent
Gutierrez et al.

(10) Patent No.: US 6,331,676 B1
(45) **Date of Patent: *Dec. 18, 2001**

(54) PRIMARY CABLE OF COMPRESSED CONDUCTOR

(75) Inventors: Carlos Tenorio Gutierrez; Artemio Martinez Corona, both of Querétaro (MX)

(73) Assignee: Servicios Condumex S.A. de C.V., Querretaro (MX)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/025,130

(22) Filed: Feb. 17, 1998

(30) Foreign Application Priority Data

Feb. 18, 1997 (MX) ..... 971243

(51) Int. Cl.[7] ..... H01B 5/08
(52) U.S. Cl. ..... 174/128.1
(58) Field of Search ..... 174/126.1, 128.1, 174/128.2, 129 R, 130, 133 R, 110 V

(56) References Cited

U.S. PATENT DOCUMENTS 3,131,469 * 5/1964 Glaze ..... 174/128.1 X
3,234,722 * 2/1966 Gilmore ..... 174/128.1 X
3,760,093 * 9/1973 Pemberton ..... 174/128.1
4,039,743 * 8/1977 Gommans ..... 174/128.1 X
4,654,477 * 3/1987 Isoda ..... 174/128.1
4,734,545 * 3/1988 Susuki et al. ..... 174/130 X
5,095,175 * 3/1992 Yoshida et al. ..... 174/128.1 X
5,133,121 * 7/1992 Birbeck et al. ..... 174/126.1 X
5,149,917 * 9/1992 Sawada et al. ..... 174/133 R X
5,216,205 * 6/1993 Fujii et al. ..... 174/128.1
5,260,516 * 11/1993 Blackmore ..... 174/128.1 X

OTHER PUBLICATIONS

Hawley, "Condensed Chemical Dictionary", 1981.*

* cited by examiner

*Primary Examiner*—Chau N. Nguyen
(74) *Attorney, Agent, or Firm*—Carmen Pili Curtis

(57) ABSTRACT

The primary cable of compressed conductor is properly a low tension primary cable with the particularity of having a same sectional area that permits to conduct, the same amount of electric current to any part of an automotive vehicle. However, its external diameter is much more smaller related to a same caliber of the same nature because of the compression that it suffers during the process of the compacted joining in a joining machine.

Figure 1:
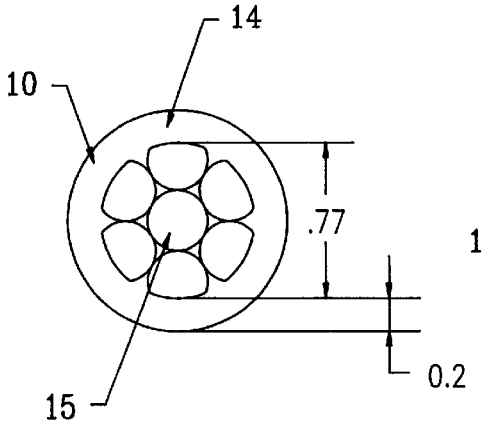

The cable of compressed conductor has several advantages over other conventional primary cables, since a bigger standardization in the insulator thickness is found and in this way, a standardization on the results of the chemical-physical, and mechanical tests is accomplished. (these tests are compulsory because of its design.)

20 Claims, 1 Drawing Sheet

PRIMARY CABLE OF COMPRESSED CONDUCTOR

BACKGROUND OF THE INVENTION

During the last decade, the automotive industry has suffered a technological transformation. This has resulted in an improvement in the application of the technology of every equipment and accessory. The most important is the electronic area of each process focused on the manufacturing of automotive primary cable of low tension. This technology has allowed the reduction of the cable size in a sectional area with the same electric current conductance.

The techniques of insulation have also improved, identifying a class of insulating materials so the wall thickness has reduced allowing a bigger cable compression.

A joint cable compacted or compressed permits modification of the harness kinds used in the automotive industry. This gives the automotive vehicles more compact aerodynamic designs more compressed and with much more power by reducing its weight and with it, lower fuel consumption.

The joint cables compacted or compressed allow the usage of a bigger space for storing the different electric circuits that have an increasing number according to new necessities such as:

Security and Convenience such as weather control, crossing control, key entrance alarms, light reminders, cleaning sensors, door alarms and window control.

Train of Power such as machine dynamic, ignition time, combustible liberators, spark distributors, turbo control, emission monitor, voltage regulator, energy recuperation alternator , adaptation of operational.

Entertainment such as noise reduction system, cellular radiotelephony, CD optic disc tape, CB radio, audio digital tape, etc. Information to the digital and analog pressures, machine diagnosis, screen, service reminders, digital clock, navigation computers, high intelligence trajectory, avoid collisions, alerts, etc.

Body control—multiplex cable, internal module network, body conductors of the Smart potency diagnosis system, dynamic ride control, active suspension, anti-theft devices, charge level, electronic steering, electronic muffle, etc. As it can be seen, the amount of the electric circuits in an automotive vehicle doesn't only influence the size and space of the vehicle but its weight and design as well.

Therefore, the objective of this invention is to enhance an automotive low tension primary cable of compressed conductor that allows to lighten the vehicle weight, to increase the fuel efficiency, to increase the production rate, to standardize the values in the chemical-physical and mechanical tests, to reduce the insulation wall thickness, to allow a bigger integration of circuits in the harness and to offer more operations, comfort and commodity to the user.

DETAILED DESCRIPTION OF THE INVENTION

Figure 2:
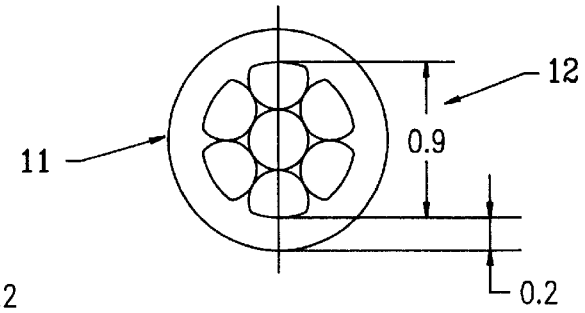
Figure 3:
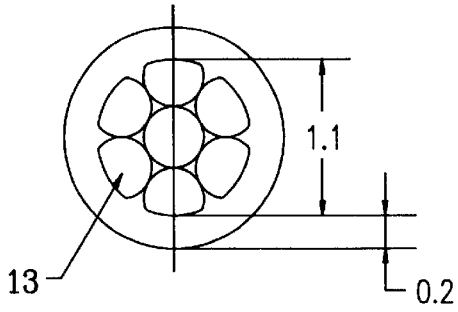

The invention is described according to the drawings of FIGS. 1 to 3, where:

FIG. 1. illustrates a sectional cut of the primary cable of joining of compacted conductor that shows the thickness of the insulation and a cross section area of a caliber of 0.35 $mm^2$ FIG. 2. illustrates a sectional cut of the cable of FIG. 1 with cross section area of 0.50 $mm^2$ FIG. 3. illustrates a sectional cut of the primary cable of joining of compressed conductor with cross section area 0.75 $mm^2$ The fabrication of the primary cable of compressed conductor requires accuracy during the extrusion of the insulating cover and a reduction of the wire size. To accomplish these conditions it is necessary to select the type of isolating material and the equipment to reduce the volume of the conventional cable.

The primary cable of the invention 10, is properly a low tension primary cable, with the particularity of having an unchanged sectional area 11 and therefor it allows conduction of the same amount of electric current to any part of the automotive vehicle.

However, its external diameter 12, is dimensionally smaller in comparison to a same caliber of the same nature of non-compacted joint in a joining machine.

This cable is fabricated with red copper wires 13, drawn by drawing machines of one-row as first stage; as second stage a joining machine with pre-twister must be used so the joining- compacted operation can be done in the same way; finally, the Extrusion Stage, it will be set in a surrounding way to have a thickness of equal insulation a cover or insulation 14, of thermoplastic component of PVC polyvinylchloride with classification 90° with extra thin walls and with great resistance to abrasion in any extrusion machine for thermoplastic, accomplishing bigger numbers of production comparing it to a conventional primary cable.

The primary cable of compressed conductor has several advantages in comparison to the other conventional primary cables, since a higher degree of standardization (i.e., uniformity) is found in the insulation thickness and with this a standardization in the results of the chemical-physical and mechanical tests is achieved. (these tests are compulsory because of its design).

The cable has been designed for a usage in the fabrication of automotive harness where it will be exposed to work temperatures of −40° C. to 105° C., the range of temperatures specified by design of the electric systems.

The joint cable 10, presents a nucleus 12, constituted by a central wire 15, surrounded by at least six wires 13, pre-twisted that form the joint nucleus and with wires of caliber 0.0325 mm with a sectional area of 0.35 $mm^2$ and 0.2 mm thick of insulator.

This cable must be fabricated such that when compacted, no more than the maximum electric resistance allowed is accomplished since this is the characteristic that commands and will rule on the cable design.

The fabrication of the cable of this invention requires precision during the extrusion of the insulating cover and size reduction of the wire. To have these conditions it is necessary to reduce select the kind of insulating material, and to select the equipment necessary to reduce the size of the nucleus of the conventional cable.

The principal characteristics of the finished products are:

A) It reduces the weight of the product.

B) Thinner harnesses are obtained.

C) The flexibility of the harnesses is increased by allowing a bigger amount of circuits in it D) Advantages in the terminal application, by the insulator displacement E) It permits increased productivity in the extrusion process since in this way equipment stoppages caused by thread (loosened wires) will be avoided.

F) It permits the achievement of the performance standards on the abrasion tests, oil, heat, tension, lengthen and low temperatures resistance.

Raw Material Physical Characteristics

| CHARACTERISTIC | SPECIFIED VALUE |
|---|---|
| Diameter | 7.620 to 8.38 mm<br>8.00 mm + −0.38 m |
| Lengthen | 30% minimum |
| Twist resistance | 50 minimum |
| Conductivity | 101.00% IACS minimum |
| Resistance | 0.15176 Ω g/m maximum |
| Oval | 0.50 mm maximum |

after describing the invention, it is considered a novelty and the following is claimed:

We claim:

1. Compressed conductor, low tension primary cable suitable for use in automotive wiring harness wherein the cross sectional area of a wire nucleus is unchanged which allows conduction of an unchanged amount of electric current as compared to a corresponding non-compressed cable characterized by a one-row joint of previously drawn, pre-twisted copper wires around a central wire that together form a conductor nucleus; wherein the joint is compacted by the pre-twisting of the wire nucleus till close to the limits of its electric resistance; whereby the nucleus is free of internal and external voids; and further comprising directly adjacent to the conductor nucleus is an external surrounding cover extruded of insulator comprising a thermoplastic component consisting essentially of a single layer of polyvinylchloride formulation wherein the external cover has a thin wall and high electrical resistance.

2. Primary cable as in claim 1, wherein the thermoplastic component comprises poly vinylchloride (PVC) formulation rated for 90° C.

3. Primary cable as in claim 1 wherein the cover has improved uniformity of thickness which provides an automotive wiring harness of reduced size and weight.

4. Primary cable as in claim 1 wherein the cable is adapted to withstand exposure to working temperatures of −40° C. to 105° C.

5. The primary cable as in claim 1 wherein the wire around the central wire has a caliber of 0.325 mm with a cross sectional area of 0.35 $mm^2$ and said external cover is 0.2 mm thick.

6. In an automotive wiring harness comprising one or more low tension primary cables wherein the cable(s) comprises a conductor nucleus and directly adjacent to the nucleus is a surrounding external insulating extruded thermoplastic cover consisting essentially of a single layer of polyvinyl chloride formulation; wherein said conductor nucleus is compressed.

7. The automotive wiring harness of claim 6, wherein said conductor nucleus comprises a one row joint of copper wires around a central wire, and wherein said cable is fabricated in three stages comprising:

a) copper wires are drawn by one-row drawing machine, followed by:

b) passage through a joining machine having pre-twister means so as to form said conductor nucleus and wherein said compression is achieved by compacting resulting from the pre-twisting of the wires which surround the central wire of said nucleus and whereby the conductor nucleus is compacted to achieve about the minimal electrical resistance and to reduce or eliminate voids; and c) extruding said thermoplastic cover around said conductor nucleus.

8. The automotive wiring harness of claim 7, wherein the thermoplastic cover is a polyvinylchloride formulation rated for 90° C. and said cover has been extruded in such manner as to both reduce the cross-sectional area and improve the uniformity of thickness and thus the resulting weight of the cable as compared to a conventional cable with a non-compressed conductor nucleus.

9. The automotive wiring harness of claim 8 wherein the said cable is adapted to withstand exposure to working temperatures of −40° C. to 105° C.

10. The automotive wiring harness of claim 6, wherein the conductor nucleus comprises copper wires.

11. The automotive wiring harness of claim 10 wherein the external insulating extruded thermoplastic cover comprises a polyvinylchloride formulation rated for 90° C. and wherein the external extruded thermoplastic cover has a thin wall and high electrical resistance.

12. The automotive wiring harness of claim 11 wherein said compressed conductor nucleus has a cross section area of 0.35 $mm^2$ and wherein said external insulating cover is 0.2 mm thick.

13. The automotive wiring harness of claim 11 wherein said compressed conductor nucleus has a cross section area of 0.50 $mm^2$.

14. The automotive wiring harness of claim 11 wherein said compressed conductor nucleus has a cross section area of 0.75 $mm^2$.

15. A primary cable of compressed conductor comprising:

a) a central core wire;

b) a plurality of wires around the core wire; and c) an external insulating cover surrounding and directly adjacent the plurality of wires, said cover comprising a thermoplastic component consisting essentially of a single layer of polyvinyl chloride; wherein said wire is pretwisted to form the joint nucleus and the external cover has a thin wall and high electrical resistance.

16. The primary cable of claim 13 for use in automotive wiring harness.

17. The primary cable of claim 13 wherein the plurality of the wires comprising at least six wires are pretwisted that form a nucleus.

18. The primary cable of claim 13 wherein the wires around the core wire has a caliber of 0.325 mm with a sectional area of 0.35 $mm^2$ and said external cover is 0.2 mm thick.

19. The primary cable of claim 13 wherein a nucleus comprises copper wires.

20. The primary cable of claim 15 adapted to withstand exposure to working temperatures in the range of −40° C. to 105° C.

* * * * *